US005406057A

United States Patent [19]

Komatsu et al.

[11] Patent Number: 5,406,057

[45] Date of Patent: Apr. 11, 1995

[54] MICROWAVE OVEN DOOR PORTION HAVING IMPROVED MECHANICAL STRENGTH

[75] Inventors: Morimasa Komatsu; Yukihito Hosono, both of Tokyo, Japan

[73] Assignee: Kabushiki Kaisha Toshiba, Kawasaki, Japan

[21] Appl. No.: 78,022

[22] Filed: Jun. 18, 1993

[30] Foreign Application Priority Data

Jun. 18, 1992 [JP] Japan ..... 4-159230

[51] Int. Cl.[6] ..... H05B 6/76

[52] U.S. Cl. ..... 219/740; 219/739; 174/35 MS; 126/198

[58] Field of Search ..... 219/740, 741, 739, 742; 126/198, 200; 174/35 MS, 35 GC, 35 R

[56] References Cited

U.S. PATENT DOCUMENTS

| | | | |
|---|---|---|---|
| 3,431,348 | 3/1969 | Nellis et al. | 219/740 |
| 3,711,673 | 1/1973 | Takeda et al. | 219/740 |
| 4,051,341 | 9/1977 | Tanaka et al. | 219/740 |

FOREIGN PATENT DOCUMENTS

| | | | |
|---|---|---|---|
| 0184069 | 6/1986 | European Pat. Off. . | |
| 2649308 | 5/1978 | Germany . | |
| 61-56745 | 3/1986 | Japan . | |
| 62-223528 | 10/1987 | Japan | 219/740 |
| 63-299085 | 12/1988 | Japan | 219/740 |
| 2-304893 | 12/1990 | Japan | 219/740 |

OTHER PUBLICATIONS

Patent Abstracts of Japan, vol. 10, No. 18 (M-448)(2075) 24 Jan. 1986 & JP-A-60 178 225 (Sanyo Denki KK) 12 Sep. 1985 *abstract*.

*Primary Examiner*—Philip H. Leung

*Attorney, Agent, or Firm*—Cushman Darby & Cushman

[57] ABSTRACT

A door of a microwave oven comprises a metal sheet having a window in a central portion thereof, and a support plate and a transparent glass plate. The metal sheet has a flange formed by press molding, which surrounds the central portion of the metal sheet. The window comprises at least two kinds of hole. A diameter of a first hole is larger than that of a second hole. The first holes are located in the center of the window. The second holes are located each side of an area of the first holes. To manufacture the metal sheet construction, a punch having first pins and second pins, punches simultaneously a row of the first holes and the second holes in a piece of metal sheet. Next, the metal sheet is relatively moved to the punch. The punch punches a next row of the first holes and the second holes. The punching and being moved process are alternatively repeated until the window is made. Finally, the metal sheet is press molded.

21 Claims, 5 Drawing Sheets

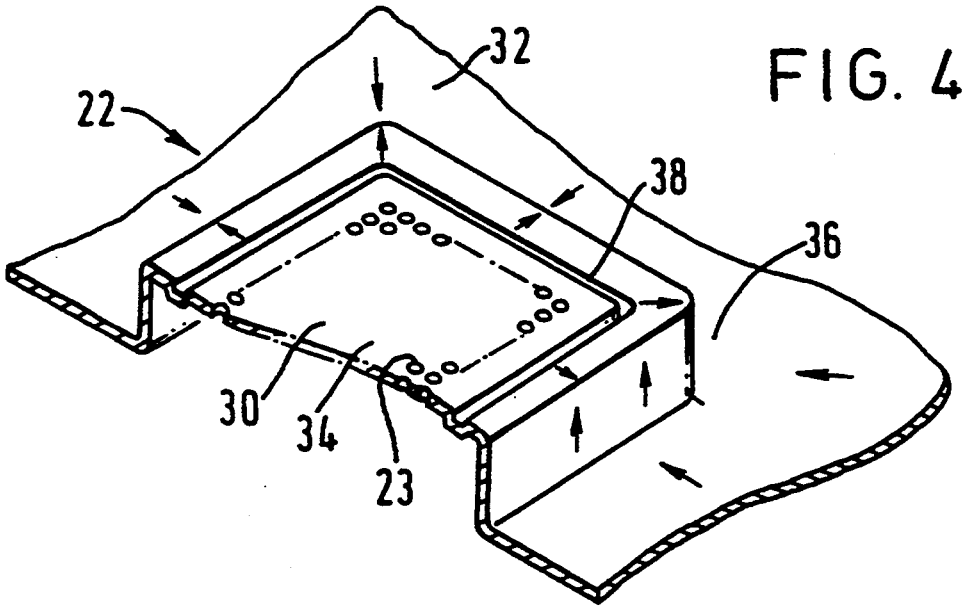
FIG. 4.
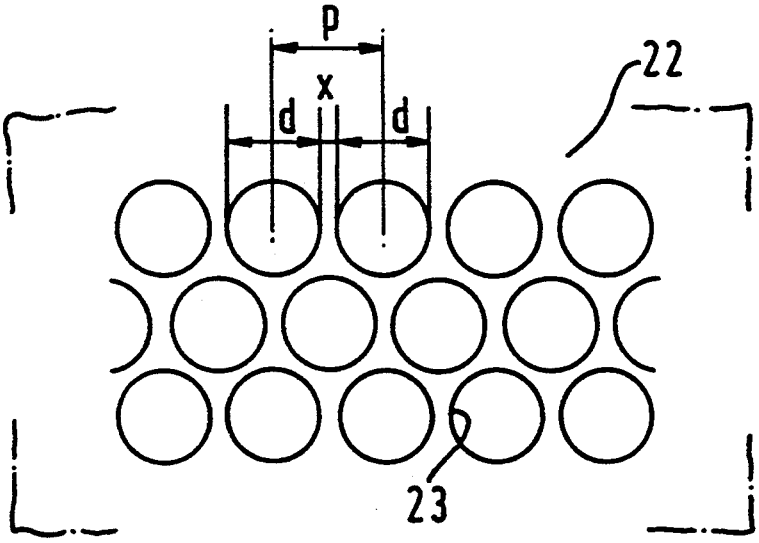
FIG. 5.
FIG. 6.
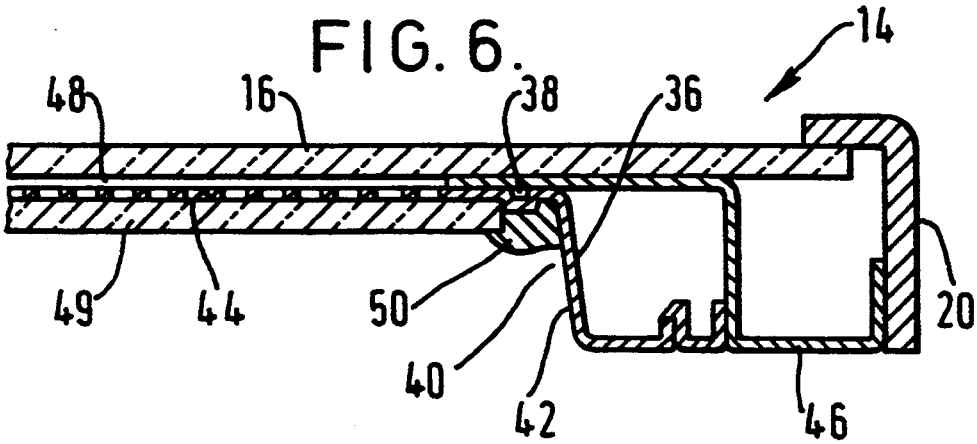

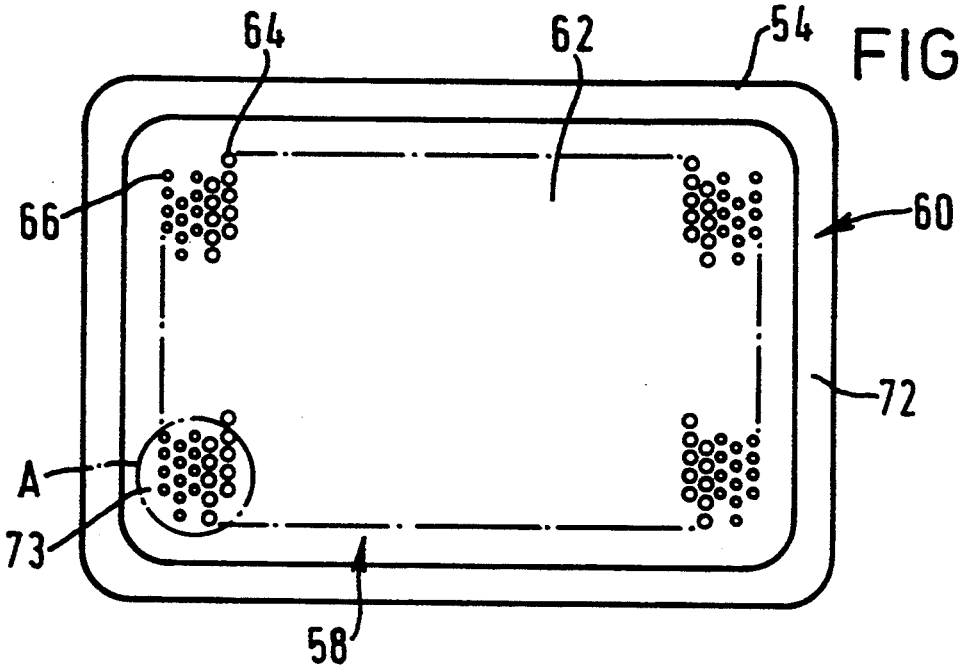
FIG. 7.
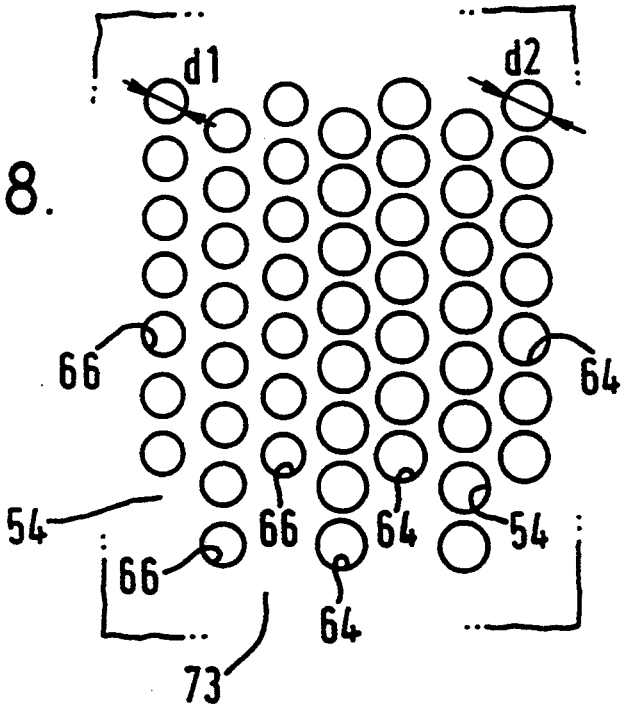
FIG. 8.
FIG. 9.
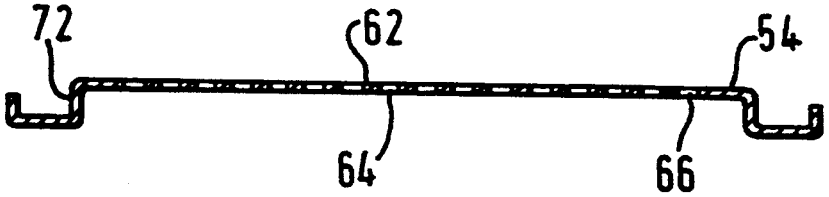

MICROWAVE OVEN DOOR PORTION HAVING IMPROVED MECHANICAL STRENGTH

BACKGROUND OF THE INVENTION

The present invention relates in general to the production of a metal sheet with plural holes therein. More particularly, the invention relates to metal sheets suitable for use as a part of a microwave oven door.

A microwave oven door comprises a transparent glass plate and a thin metal sheet of generally rectangular shape with plural small holes in a central "window" portion thereof. Food cooking in a cooking cabinet of the oven can be viewed through the glass plate and the holes in the metal sheet. If the holes are made sufficiently small, microwaves do not pass through the holes to the outside of the cooking cabinet. The metal sheet reinforces the door. Surrounding the window portion of the metal sheet there is an edge portion which has a flange formed by press molding.

A typical way to manufacture such a metal sheet is to first punch small holes in a portion of the metal sheet having a thickness of, for example, 0.6 mm. After punching the holes, the edge portion of the sheet is press molded to form the flange.

The user wants to be able to easily see the food in the cooking cabinet through the window portion of the metal sheet. Safety requires that the holes be sufficiently small to block microwaves. However, in order to see the food being cooked easily, it is desirable to make the holes as large as possible.

A so called "opening ratio" represents the total area of the holes divided by the area of the window portion of the metal sheet. To promote visibility, it is desirable to have a large opening ratio.

However, if the diameter of the holes is made large, a width of metal separating the holes from each other becomes narrow. As a result, a strain strength of the window portion becomes low. When the flange is formed by press molding, the central portion of the metal sheet is strained to the outside of the metal sheet. The corner area of the central portion is particularly strained. If the strain strength of the metal sheet is insufficient because the holes are large, the metal sheet will break during press molding.

In general, to prevent such breaking, the diameter of holes punched in the window portion of the metal sheet is made small. For example a pitch between two holes is usually 1.6 mm and the hole diameter is 1.2 mm. These typical pitch and diameter measurements cause the opening ratio to be about 51%, which is not sufficient for good visibility through the door.

Another approach to solving this problem includes a welding operation. A metal sheet has a central window portion with plural holes punched therein. A separately manufactured frame is welded to the metal sheet. The opening ratio can be made sufficient for good visibility, however the welding process is complicated and more materials are required. This makes the production cost high and this alternative unacceptable. Also, the strength of the metal sheet is reduced during the manufacturing process.

SUMMARY OF THE INVENTION

It is an object of the present invention to provide a metal sheet suitable for use in a microwave oven door which has holes in a central window portion that are sufficiently large for good visibility and which is easy to manufacture.

It is another object of the present invention to provide a method of manufacture of a metal sheet for a microwave oven door that is low in cost.

The present invention achieves these objects by providing a novel metal sheet construction, a microwave door arrangement incorporating the metal sheet construction and a new method of manufacture.

The metal sheet construction includes a piece of sheet metal. The sheet metal has a central portion with holes punched therein. A part of the central portion, known as a window portion has a plurality of first holes therein. A plurality of second holes are punched in the central portion surrounding the window portion.

The first holes punched in the window portion are made sufficiently small in diameter to block microwaves used for cooking. In one embodiment, the plurality of second holes are punched at corner regions of the central portion surrounding the window portion. The area of each second hole is smaller than that of each first hole. An edge portion surrounds the central portion. This edge portion has a flange which is formed by press molding.

The present invention also provides a microwave oven door arrangement incorporating a metal sheet and a method of manufacture.

BRIEF DESCRIPTION OF THE DRAWINGS

In the accompanying drawings:

FIG. 4 is a cut away perspective view of a metal sheet construction according to a first embodiment of this invention.

FIG. 5 defines the diameter and pitch of holes in the metal sheet construction;

FIG. 6 is a sectional view of a door including a meal sheet construction according to a second embodiment of this invention;

FIG. 7 is a plane view of a metal sheet construction according to a third embodiment of this invention;

FIG. 8 is an enlarged plane view of an area A of FIG. 7;

FIG. 9 is a sectional view of the metal sheet according to the third embodiment of this invention;

DETAILED DESCRIPTION OF THE PREFERRED EMBODIMENTS

Figure 1:
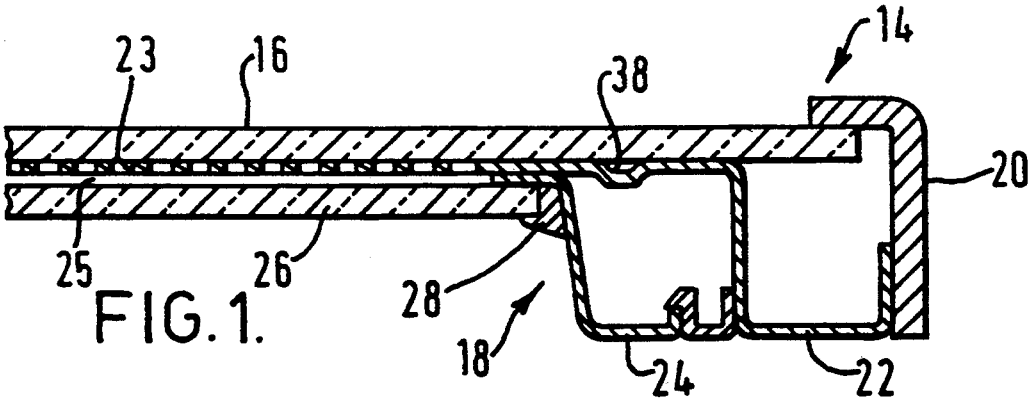
FIG. 1 is a sectional view of a microwave oven door including a metal construction in accordance with a first embodiment of the present invention.
Figure 2:
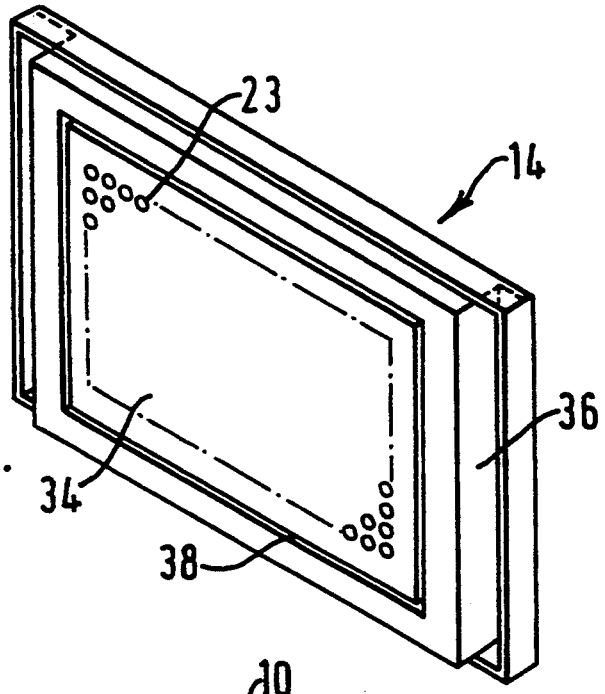
FIG. 2 is a perspective view of a microwave oven door according to the present invention.
Figure 3:
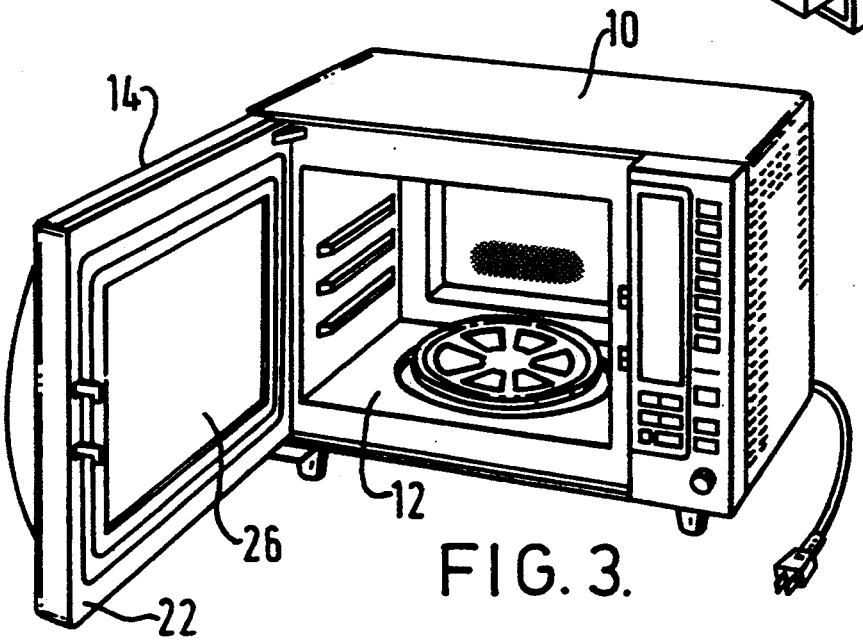
FIG. 3 is a perspective view of the microwave oven including a door according to the present invention.
Figure 10:
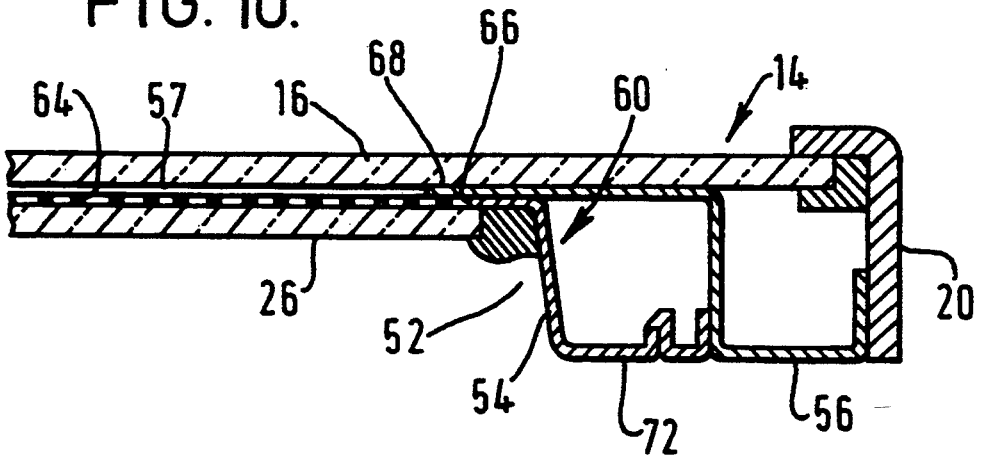
FIG. 10 is a sectional view of a door according to the third embodiment of this invention.

A first embodiment, in which the present invention is employed in a microwave oven, will be described with reference to FIGS. 1 to 5. As shown in FIG. 3, a microwave oven 10 has a cooking cabinet 12 for receiving food to be cooked. A door 14 is pivotally provided in front of cooking cabinet 12. A transparent glass plate 16 of door 14 is supported by a main body 18 (see FIG. 1). A frame-shaped sash 20 is provided around main body 18, and the sash is connected to glass plate 16.

Main body 18 comprises a metal sheet 22 having plural holes 23 and an inner plate 24 with an opening 25 made of steel plate shaped as a rectangular frame. Metal sheet 22 is welded to inner plate 24 so that plural holes 23 are aligned with opening 25. A transparent inner glass plate 26 is fixed to inner plate 24 by a seal member 28 so that the inner glass plate covers opening 25.

Metal sheet 22 has a central portion 30 and an edge portion 32 which surrounds the central portion. A rectangular window 34 having plural holes 23 is positioned in central portion 30 so that the user can see food in cooking cabinet 12 through the window. A flange 36 is formed by press molding in edge portion 32 so that the flange is raised in a rear surface of door 14. Metal sheet 22 is formed so as to have a concave shaped portion 38 around window 34, between the window and flange 36. A depth of concave shaped portion 38 is shallower than that of flange 36. In this embodiment, metal sheet 22 is made of steel plate of thickness 0.6 mm. A formation pitch p of holes 23 is 1.6 mm, and their diameter d are 1.4 mm so that the opening ratio, which indicates a ratio of an area of all holes to an area of window 34, is 69%. Holes 23 prevent microwave from passing through door 14 from cooking cabinet 12.

A method of manufacturing metal sheet 22 will now be described. A plain metal sheet whose thickness is 0.6 mm is cut in a rectangular shape with a bit wider than an outline of metal sheet 22. Then, plural holes 23 are punched out in a rectangular shaped area so called window 34 in rows. The formation pitch p of holes is set to 1.6 mm, and their diameter d are set to 1.4 mm. The concave shaped portion 38 is formed by a press machine around window 34. At edge portion 32 flange 36 is formed by press molding. At the last, unnecessary parts of edge portion 32 are trimmed, in addition, required bending and hole punching are carried out so that metal sheet 22 is formed.

When flange 36 is formed by press molding, as shown by arrows in FIG. 4, central portion 30 and edge portion 32 being close to window 34 are expanded toward an outside of the edge portion. Since concave shaped portion 38 absorbs an outward force which intends to expand central portion 30 outward, however, most of the outward force does not affect window 34. As a result, even though some stretch deformation occurs in concave shaped portion 38, window 34 is not deformed and broken.

According to the first embodiment, since concave shaped portion 38 is formed between holes 23 and flange 36, the concave shape prevents the outward force which is derived from the press molding of the flange. As a result, most of the outward force does not affect window 34. Therefore, even though the diameter d is increased from 1.2 mm (prior art) to 1.4 mm, window 34 is not deformed and broken.

As a result, compared with prior art, opening ratio can be increased from 51% to 69% so that the user can easily see food through window 34.

Moreover, since metal sheet 22 is made of single metal plate, additional process such as connecting window 34 to flange 36 is not required. Therefore, metal sheet 22 can be made in a low cost.

As concerns manufacturing metal sheet 22, since welding process is not required, it is easy to make the metal sheet only using a press machine.

FIG. 6 shows a second embodiment of this invention. Corresponding reference numerals represent like or corresponding parts in the first embodiment described above. A main body 40 comprises a metal sheet 42 having plural holes 44 and an inner plate 46 with an opening 48 made of steel plate shaped as a rectangular frame. Metal sheet 42 is welded to inner plate 46 so that plural holes 44 are in accordance with opening 48. A transparent inner glass plate 49 is fixed to metal sheet 42 by a seal member 50 so that the inner glass plate covers plural holes 44. Inner plate 46 is provided between glass plate 16 and metal sheet 42.

Concave shaped portion 38 may be formed intermittently so that the concave shaped portion surrounds window 34. Concave shaped portion 38 may be formed on each corner of window 34, that is at least four portions. In manufacturing, after concave shaped portion 38 is formed, holes 44 may be punched. The process forming concave shaped portion 38 and the press molding process may be carried out in one continuous process.

A third embodiment will be described with reference to FIGS. 7 to 11. Corresponding reference numerals represent like or corresponding parts in the first embodiment described above. A main body 52 comprises a metal sheet 54 and an inner plate 56 with an opening 57 made of steel plate shaped as a rectangular frame. Metal sheet 54 has a central portion 58 and an circular edge portion 60. A window 62 having plural first holes 64 and plural second holes 66 is positioned in central portion 58 so that the user can see food in cooking cabinet 12 through the window. Second holes 66 in three row are positioned on each longitudinal side of first holes 64. A diameter d1 of second hole 66 is smaller than a diameter d2 of first hole 64, for example, the diameter of the second hole is 1.2 mm and a pitch p of the second holes is 1.6 mm, and the diameter of the first hole is 1.4 mm and a pitch p of the first hole is same length as that of the second hole.

Metal sheet 54 is welded to inner plate 56 so that opening 57 is accordance with window 62. To be exact, opening 57 is accordance with first holes 64 and half of second holes 66, that is, second holes 66 is overlapped with an edge portion 68 of inner plate 56. The opening ratio of window 62 is about 69%.

Figure 11:
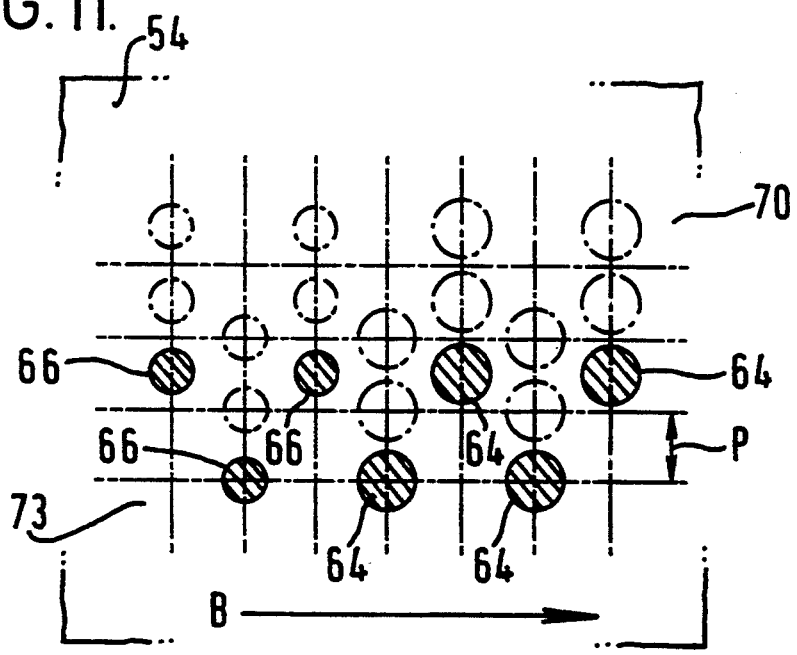
FIG. 11 shows a connection between a punch and the metal sheet with the third embodiment of this invention.
Figure 12:
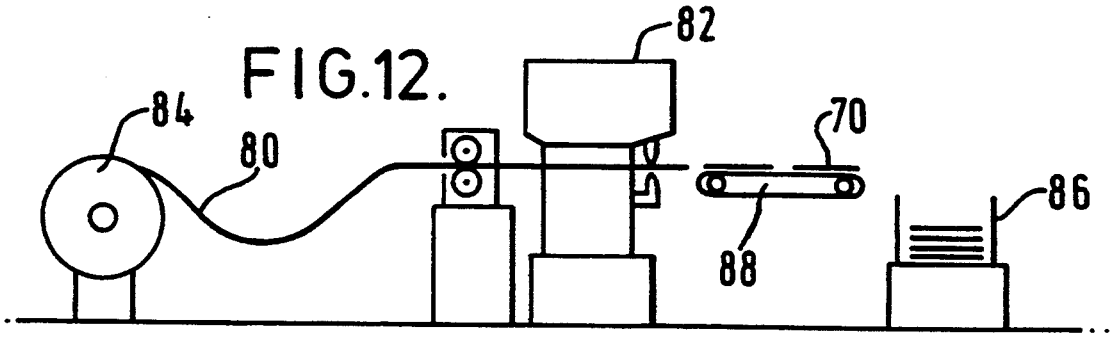
FIG. 12 is a side view which indicates how to make a metal sheet with the third embodiment of this invention.

A method of manufacturing metal sheet 54 according to the third embodiment will be described. A series of metal sheet 80 is sent to a punch machine 82 from a roll of metal sheet 84. Punch machine cuts off a plain sheet 70 as shown in FIG. 11 from the series of metal sheet 80. When first holes 64 and second holes 66 are punched in plain sheet 70, punch machine 82 which has small punches for second holes 66 and big punches for first holes 64 in a row is placed so that the row is against a length direction B. First holes 64 and second holes 66 with hatching as shown in FIG. 11 accord with a pattern of the small and big punches. The plain plate 70 is sent to the punch machine by a pitch p of 1.6 mm. The punch machines punches first holes 64 and second holes 66 in a next row. Two processes of punching holes and being sent to punch machine 82 are repeatedly operated alternately until window 62 is completely formed. Then, each punched sheet 70 is conveyed to a storage case 86 by a belt conveyer 88. Every punched sheets 70 are piled up in storage case 86.

After that, a flange 72 of edge portion 68 is formed by press molding with a press device as same manner as the first embodiment. Then, a required process such as cutting and bending is carried out so that metal sheet 54 is formed.

In the third embodiment, when flange 72 is formed by press molding, window 62 is expanded toward an outside of edge portion 60. The expanding force influences at each corner 73 of window 62 more powerfully. Since second holes 66 which are located at each corner 73 of window 62 are smaller than first holes 64, however, separating pieces between the second holes are large enough to prevent window 62 from a deformation and/or breakage by the expanding force. Therefore, even though first holes 64 are formed bigger than second holes 66, the deformation and/or breakage of window 62 can be prevented.

According to the third embodiment, since holes 66 are located on each side of first holes 64, and the diameter of the second hole being smaller than that of the first hole, separating pieces between the second holes prevent window 62 from a deformation and/or breakage.

Therefore, since almost all of window 62 has first holes 64 of big diameter such as 1.4 mm, the user can plainly see something through window 62, and especially in the case of door 14 of microwave oven 10, the user can plainly see food in cooking cabinet 12 through the window without the deformation and breakage of the window.

Although second holes 66 being a small diameter are formed in window 62, a part of the second holes are covered by edge portion 70, and the second holes are positioned only in the outermost rim of the window. As a result, second holes 66 do not substantially disturb the user to see food through window 62.

Since window 62 is formed incorporated with flange 72, a sufficient reinforcement effort of door 14 can be obtained. Manufacture can be achieved at low cost when compared with types with separate members.

Although first hole 64 and second hole 66 have different diameter, since the first hole and the second hole are punched in a single process, an additional process is not required.

According to the inventor's experiments, it was proved that in a condition of a pitch p being 1.6 mm and a diameter of second hole 66 being 1.2 mm, a diameter of first hole 64 can be 1.5 mm. In the above condition, an opening ratio is about 80%.

Figure 13:
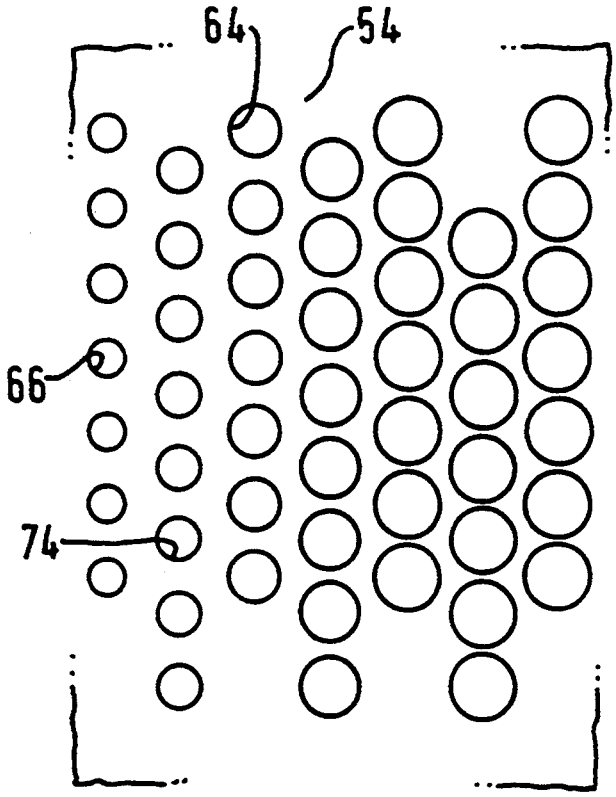
FIG. 13 is a plane view of a metal sheet according to a fourth embodiment of this invention.

Moreover, with reference to FIG. 13, a third hole 74 having a intermediate diameter between first hole 64 and-second hole 66 may be provided between the first hole and the second hole. For example, a diameter of first hole 64, second hole 66 and third hole 74 is 1.4 mm, 1.3 mm and 1.2 mm, respectively. More than three kinds of hole are available.

Figure 14:
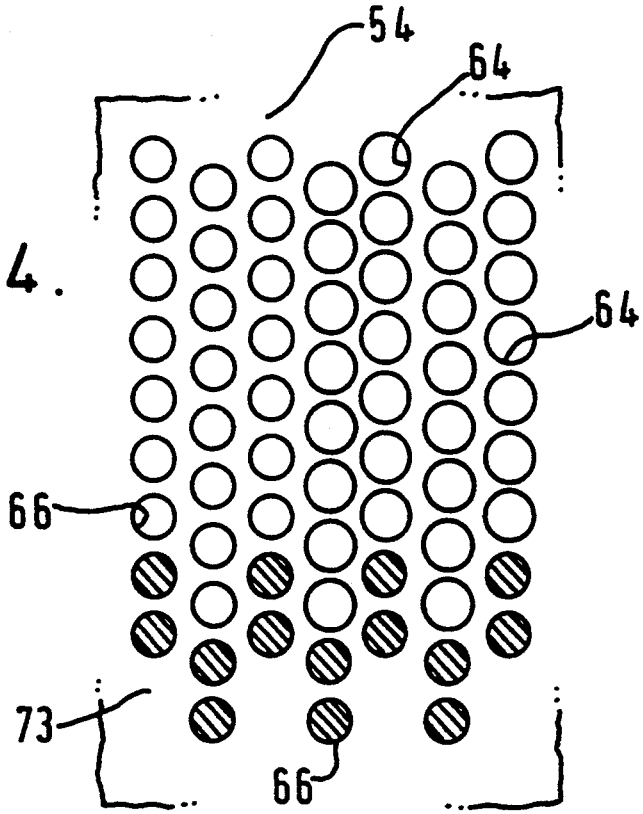
FIG. 14 is a plane view of a metal sheet according to a fifth embodiment of this invention.

Second hole 66 may be provided only four corners 73 of window 62. Second hole 66 may be provided around window 62 as shown in FIG. 14. In that case, second hole 66 with hatching are punched in a difference process.

Although only a few embodiments have been described in detail above, those having ordinary skill in the art will certainly understand that many modifications are possible in the preferred embodiment without departing from the teachings thereof. Fore example, a thickness of a metal sheet, a pitch of holes, and a diameter of hole are changeable in accordance with a purpose of using. The metal sheet is not limited to be employed in a microwave oven door.

Moreover, a window is not limited to a rectangular type, a shape of the window is available as circular including ellipse. In this case, a concave shaped portion or second holes surround the circular window, because every place of outside of the window has equally weak strength against press molding.

All such modifications are intended to be encompassed within the following claims.

What is claimed is:

1. A metal sheet construction, comprising a sheet of metal having a) a central portion including a smaller window portion within the central portion, the window portion being defined by plural first holes therein that are sufficiently small to substantially block microwaves, the central portion having, at corner regions thereof surrounding said window portion, second holes therein, an area of each second hole being smaller than that of each first hole; and b) an edge portion surrounding the central portion having a flange formed by press molding.

2. A metal sheet construction according to claim 1, wherein a ratio of a combined area of the first holes to an area of the central window portion exceeds 69%.

3. A metal sheet construction according to claim 1, wherein each first hole is circular and has a first diameter, and each second hole is circular has a second diameter which is smaller than the first diameter.

4. A metal sheet construction according to claim 3, wherein the first diameter is 1.4 mm to 1.5 mm and a pitch between two first holes is 1.6 mm.

5. A metal sheet construction comprising a sheet of metal having:

a) a central portion and a smaller window portion within the central portion, the window portion being defined by a plurality of first holes therethrough that are sufficiently small to substantially block microwaves, the central portion having therein a plurality of second holes arranged in lines on each side of the window portion, an area of each second hole being smaller than that of each first hole; and b) an edge portion surrounding the central portion having a flange being formed by press molding.

6. A metal sheet construction according to claim 5, further including a line of plural third holes provided between a line second holes and the first holes, an area of each third hole being larger than that of each second hole and smaller than that of each first hole.

7. A metal sheet construction according to claim 5, wherein the second holes surround the window portion.

8. A metal sheet construction, comprising a sheet of metal having:

a) a central portion and a window portion within said central portion, the window portion being defined by plural holes that are sufficiently small to substantially block microwaves, the central portion having a concave surrounding at least a portion of said the window portion, said concave having respective edges which are coplanar with a surface of the metal sheet onto which said plural holes open; and b) an edge portion surrounding the central portion having a flange formed by press molding, said concave being constructed and arranged to absorb an outward force due to press molding thereby preventing damage to said plural holes.

9. A metal sheet, construction comprising a sheet of metal having:

a) a central portion and a window portion within said central portion, the central portion having plural holes therein that are sufficiently small to substantially block microwaves, the central portion having a concave surrounding the window portion, said concave having respective edges which are coplanar with a surface of the metal sheet onto which said plural holes open; and b) an edge portion surrounding the central portion, the edge portion having a flange formed by press molding that is deeper than the depth of the concave of the central portion, said concave being constructed and arranged to absorb prevent an outward force due to press molding thereby preventing damage to said plural holes.

10. A metal sheet construction according to claim 9, wherein the window portion is circular.

11. A metal sheet construction according to any one of claims 1 through 9, wherein the window portion is substantially rectangular.

12. A door for a microwave oven, comprising:

a) a metal sheet construction comprising sheet of metal having a central portion and a window portion within said central portion, the window portion having plural first holes therein that are sufficiently small to substantially block microwaves, the central portion having plural second holes therein positioned at each corner of the central portion, surrounding the window portion, an area of each second hole being smaller than that of each first hole; and an edge portion surrounding the central portion having a flange formed by press molding;

b) a frame-shaped support plate having an opening confronting the window portion of the sheet metal and connected thereto; and c) a transparent plate provided outside of the support plate and the metal sheet, an area of the transparent plate being larger than that of the support plate opening, so that the user can see food or the like received in the cooking cabinet through the transparent plate, the first holes, and the opening.

13. A door according to claim 12, wherein the frame-shaped support plate is opaque and the support plate confront the second holes, so that a user cannot see food or the like received in the cooking cabinet through the second holes.

14. A microwave oven door, comprising:

a) a metal sheet construction comprising a sheet of metal having a central portion and a window portion within the central portion, the window portion having plural first holes therein that are sufficiently small to substantially block microwaves, and a line of plural second holes in the central portion on each side of the window portion, an area of each second hole being smaller than that of each first hole; and an edge portion surrounding the central portion having a flange formed by press molding;

b) an opaque frame-shaped support plate, having an opening confronting the window portion in a center of the support plate, and which confronts the line of the second holes, the support plate being connected to the metal sheet; and c) a transparent plate provided an outside of the support plate and the metal sheet, an area of the transparent plate being larger than that of the opening, so that a user can see food or the like received in the cooking cabinet through the transparent plate, the first holes, and the opening.

15. A door for closing a cooking cabinet of a microwave oven, comprising:

a) a metal sheet having:

a central portion and a window portion within said central portion, the window portion having plural holes therein that are sufficiently small to substantially block microwaves, the central portion having a concave surrounding the window portion, said concave having respective edges which are coplanar with a surface of the metal sheet onto which said plural holes open; and an edge portion surrounding the central portion having a flange being formed by press molding, said concave being constructed and arranged to absorb outward force due to press molding thereby preventing damage to said plural holes;

b) a frame-shaped support plate, which forms an opening confronting the window portion in a center of the support plate; and c) a transparent plate provided on an outside of the support plate and the metal sheet, an area of the transparent plate being larger than that of the opening, so that an interior of the cooking cabinet is visible from outside the cooking cabinet through said transparent plate, the holes, and the opening of said support plate.

16. A door for closing a cooking cabinet of a microwave oven, comprising:

a) a metal sheet, comprising:

a central portion having a window portion therein, the window portion having plural holes therein that are sufficiently small to substantially block microwaves, the central portion having a concave surrounding the window portion, said concave having respective edges which are coplanar with a surface of the metal sheet onto which said plural holes open; and an edge portion surrounding the central portion having a flange that is deeper than the depth of the concave of the central portion, the flange formed by press molding said concave being constructed and arranged to absorb outward force due to press molding thereby preventing damage to said plural holes;

b) a frame-shaped support plate, which forms an opening confronting the window portion in a center of the support plate; and c) a transport plate provided on an outside of the support plate and the metal sheet, an area of the transparent plate being larger than that of the opening, so that an interior of the cooking cabinet is visible from outside the cooking cabinet through said transparent plate, the holes, and the opening of said support plate.

17. A door according to claim 16, wherein the window is circular.

18. A door according to any one of claims 12 through 16 wherein the window is substantially rectangular.

19. A metal sheet construction, comprising a sheet of metal having:

a) a central portion, having a circular window portion therein, the window portion having plural first holes therein that are sufficiently small to substantially block microwaves, the central portion having second holes surrounding the window portion, an area of each second hole being smaller than that of each first hole; and b) an edge portion surrounding the central portion having a flange formed by press molding.

20. A metal sheet according to claim 19, wherein a ratio of a combined area of the first holes to the area of the window exceeds 69%.

21. A metal sheet according to claim 19, wherein each first hole is circular and has a first diameter, and each second hole is circular has a second diameter which is smaller than the first diameter.

* * * * *